US007666235B2

(12) United States Patent
Learey et al.

(10) Patent No.: US 7,666,235 B2
(45) Date of Patent: Feb. 23, 2010

(54) MICROWAVE DRYING OF COAL

(75) Inventors: Trevor Robert Learey, Brisbane (AU); J. Michael Drozd, Raleigh, NC (US)

(73) Assignee: Industrial Microwave Systems, L.L.C., Morrisville, NC (US)

( * ) Notice: Subject to any disclaimer, the term of this patent is extended or adjusted under 35 U.S.C. 154(b) by 321 days.

(21) Appl. No.: 11/563,268

(22) Filed: Nov. 27, 2006
(Under 37 CFR 1.47)

(65) Prior Publication Data

US 2007/0151147 A1 Jul. 5, 2007

Related U.S. Application Data

(60) Provisional application No. 60/597,425, filed on Nov. 30, 2005.

(51) Int. Cl.
*C10B 57/10* (2006.01)
*C10L 5/00* (2006.01)

(52) U.S. Cl. ..... 44/626; 44/620

(58) Field of Classification Search ..... 44/620, 44/626

See application file for complete search history.

(56) References Cited

U.S. PATENT DOCUMENTS

| | | | | |
|---|---|---|---|---|
| 4,076,607 | A | 2/1978 | Zavitsanos et al. | |
| 4,259,560 | A | 3/1981 | Rhodes | |
| 4,280,033 | A * | 7/1981 | Wagener et al. | 219/700 |
| 4,282,066 | A | 8/1981 | Wagener et al. | |
| 5,393,311 | A | 2/1995 | Marhanka | |
| 2005/0160667 | A1 | 7/2005 | Weinberg et al. | |

FOREIGN PATENT DOCUMENTS

| | | | |
|---|---|---|---|
| DE | 2907886 | A1 | 9/1980 |
| DE | 3121050 | A1 | 12/1982 |
| WO | 9707185 | A1 | 2/1997 |

OTHER PUBLICATIONS

D.P. Lindroth, "Microwave Drying of Fine Coal," 1985, Report of Investigations 9005—United States Bureau of Mines, US Department of Interior, Washington. DC.*

(Continued)

*Primary Examiner*—Cephia D Toomer
*Assistant Examiner*—Ming Cheung Po
(74) *Attorney, Agent, or Firm*—James T. Cronvich

(57) ABSTRACT

A method for drying coal using microwave energy to achieve a controlled aggregate moisture content target range without starting combustion or degrading the coking qualities of the coal. Coal feed stock is first separated into fine grade coal and one or more larger grades. The fine grade coal is loaded onto a conveyor as a bed of fixed depth. The fine grade coal is conveyed continuously through a microwave-energized heating chamber for drying. The fine grade coal is dried sufficiently so that when it is combined with the larger grade coals, the moisture content of the aggregate is within a target moisture content range. By volumetrically and uniformly heating the coal, the microwave heating chamber boils away the water without heating the coal itself above about 90° C. In this way, the coal does not combust or oxidize, and its coking qualities are retained.

14 Claims, 5 Drawing Sheets

OTHER PUBLICATIONS

N.P. Chironis, "Microwaves Dry Fine Coal," Coal Age, vol. 91, No. 12, Dec. 1966, McGraw-Hill, New York.*
D.P. Lindroth, "Microwave Drying of Fine Coal," 19885, Report of Investigations 98005—United States Bureau of Mines, US Department of Interior, Washington. DC.*
N.P. Chironis, "Microwaves Dry Fine Coal," Coal Age, vol. 981, No. 12, Dec. 1966, McGraw-Hill, New York.*
D.P. Lindroth, "Microwave Drying of Fine Coal," 1985, Report of Investigations 9005—United States Bureau of Mines, US Department of Interior, Washington, DC.
N.P. Chironis, "Microwaves Dry Fine Coal," Coal Age, vol. 91, No. 12, Dec. 1986, McGraw-Hill, New York.
European Patent Office, Intranational Search Report of PCT/US06/61241, mailed Jan. 17, 2008, European Patent Office, Rijswijk, NL.

* cited by examiner

MICROWAVE DRYING OF COAL

BACKGROUND

The invention relates to microwave heating generally and, more particularly, to heating coal in a microwave-energized drying chamber to reduce the coal's moisture content.

Mechanical or thermal drying systems are used to reduce the moisture content of coal prepared and cleaned with water. Reduced moisture content means lower weight, improved handling, and higher furnace efficiency. Gas- or coal-fired ovens, which are conventionally used to dry coal, have a significant fire risk. By heating the exterior surface of a mass of coal, these conventional ovens cause the exterior surface to have a higher temperature than the corresponding interior of the coal. Simultaneously, the conventional ovens also heat the coal as well as the retained water. If the temperature of the coal is raised beyond a specific value, its coking qualities, in the case of metallurgical coal, will begin to deteriorate through oxidation. Microwaves have been used to dry coal because, at microwave frequencies, microwave energy preferentially heats the retained water instead of the coal. But, if the microwave energy is not properly controlled, microwaves can overheat the coal, which affects the coking qualities of metallurgical coal or causes combustion in thermal coal.

Thus, there is a need for a method to dry coal without adversely affecting the coking qualities of metallurgical coals or starting the combustion process in thermal coals.

SUMMARY

This need and other needs are satisfied by a method for drying coal embodying features of the invention. According to one aspect of the invention, a method for drying coal to achieve a controlled aggregate moisture content target range without diminishing the coking qualities of the coal or starting combustion is provided. The method comprises: separating a feed stock of coal by size into a first grade coal and one or more other grade coals, or other size fractions; loading the first grade coal onto a conveyor to a generally uniform bed depth; continuously conveying the bed of first grade coal along the conveyor through a microwave-energized heating chamber (microwave applicator) for drying; combining the first grade coal dried in the microwave heating chamber with the one or more other grade coals to form a target dried aggregate having a reduced moisture content; and setting the speed of the conveyor and the microwave power level of the heating chamber to reduce the moisture content of the first grade coal sufficiently so that the reduced moisture content of the dried aggregate is within the aggregate moisture content target range.

According to another aspect of the invention, a method for drying coal comprises: loading coal onto a conveyor to a fixed bed depth; conveying the bed of coal continuously through a microwave-energized heating chamber; subjecting the bed of coal to a uniform heat treatment in the heating chamber to remove moisture from the coal; and setting the conveyor speed and the microwave power level to maintain the temperature of the coal in the heating chamber below 90° C.

According to yet another aspect of the invention, a method for processing coal is provided. The method comprises: separating a feed stock of wet coal by size into a first grade coal and one or more other grade coals; determining the moisture content of each of the grades of wet coal; conveying the first grade coal through a microwave-energized heating chamber to produce a dewatered first grade coal having a reduced moisture content; combining the dewatered first grade coal and the one or more other grade coals to form an aggregate dewatered coal having a reduced aggregate moisture content; and adjusting the heat treatment of the first grade coal in the heating chamber to reduce the moisture content of the first grade coal sufficiently so that the reduced aggregate moisture content meets a specified aggregate moisture content target.

The invention also provides coal produced according to the inventive method.

BRIEF DESCRIPTION OF THE DRAWINGS

These features and aspects of the invention, as well as its advantages, are better understood by reference to the following description, appended claims, and accompanying drawings, in which:

DETAILED DESCRIPTION

Figure 1:
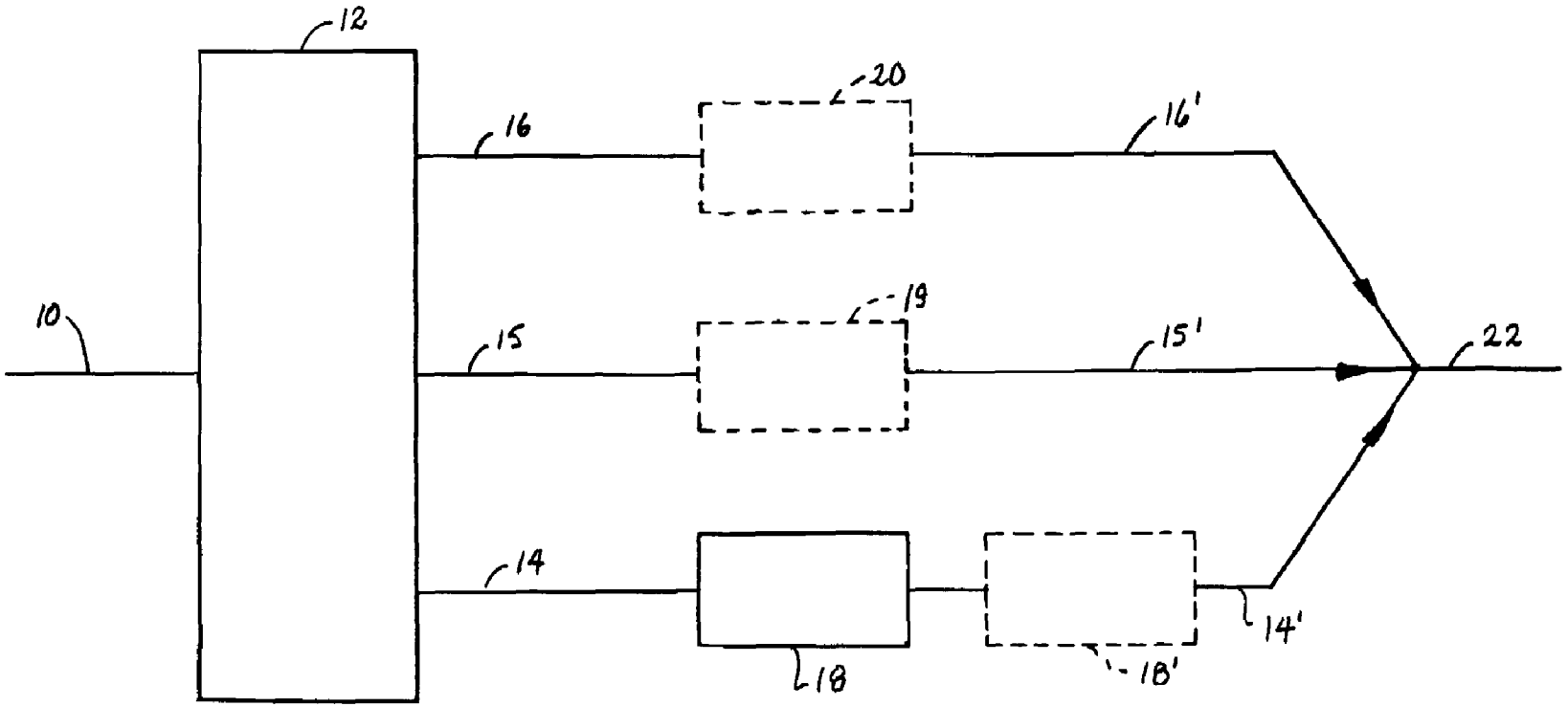
FIG. 1 is a block diagram of a coal preparation plant embodying features of the invention.

A coal preparation plant using a process embodying features of the invention is represented in the block diagram of FIG. 1. A feed stock of coal 10 is screened, graded, and cleaned in a pretreatment and cleaning stage 12. The cleaned coal is separated into three grades, in order of increasing size: fine 14, middling 15, and coarse 16. In a typical wet-cleaning process, each of the grades has a different moisture content from the others owing to their different average particle surface-area-to-volume ratios. For example, the larger-size coarse coal may have a moisture content of 8%; the middling coal may have 14%; and the fine grade coal, 25%. If the three grades are recombined into an aggregate without microwave drying, or dewatering, the aggregate moisture content might be, for example, 11-15%. But the specified moisture content target required by an end user of the coal might be 10.5%. In addition, to minimize dust and other environmental hazards, it may be preferable to maintain a moisture content in the aggregate of at least 10%. Thus, in this example, the aggregate moisture content target range is from 10% to 10.5% retained moisture.

Because the fine grade coal has the highest moisture content, drying it provides the greatest potential gain in aggregate moisture reduction. In the process shown in FIG. 1, the fine grade coal 14 is dried in a microwave-energized heating chamber 18. If, for example, the fine coal's moisture content is reduced from 25% to 14.5% in the microwave dryer, an aggregate target of 12% may be achieved. If the fine coal dryer is incapable of reducing the moisture sufficiently, the middling grade coal 15 may be similarly dried in another dryer, such as a microwave drying chamber 19. Likewise, another dryer 20 can be used to dry the coarse coal 16, if necessary. Although the microwave driers can be made to accommodate high throughput, it may be necessary to arrange multiple driers along parallel conveyors for each grade for even higher throughput. If the fine coal dryer 18 is not able to dry the coal sufficiently, a second such dryer 18' may be used in series with the first dryer 18. The dried coals 14', 15', 16' are recombined into an aggregate 22 having the targeted moisture content. In some instances, it is also possible to hit the targeted aggregate moisture content by microwave-drying instead the middling coal or the coarse coal or some combination of the various fractions.

Figure 2:
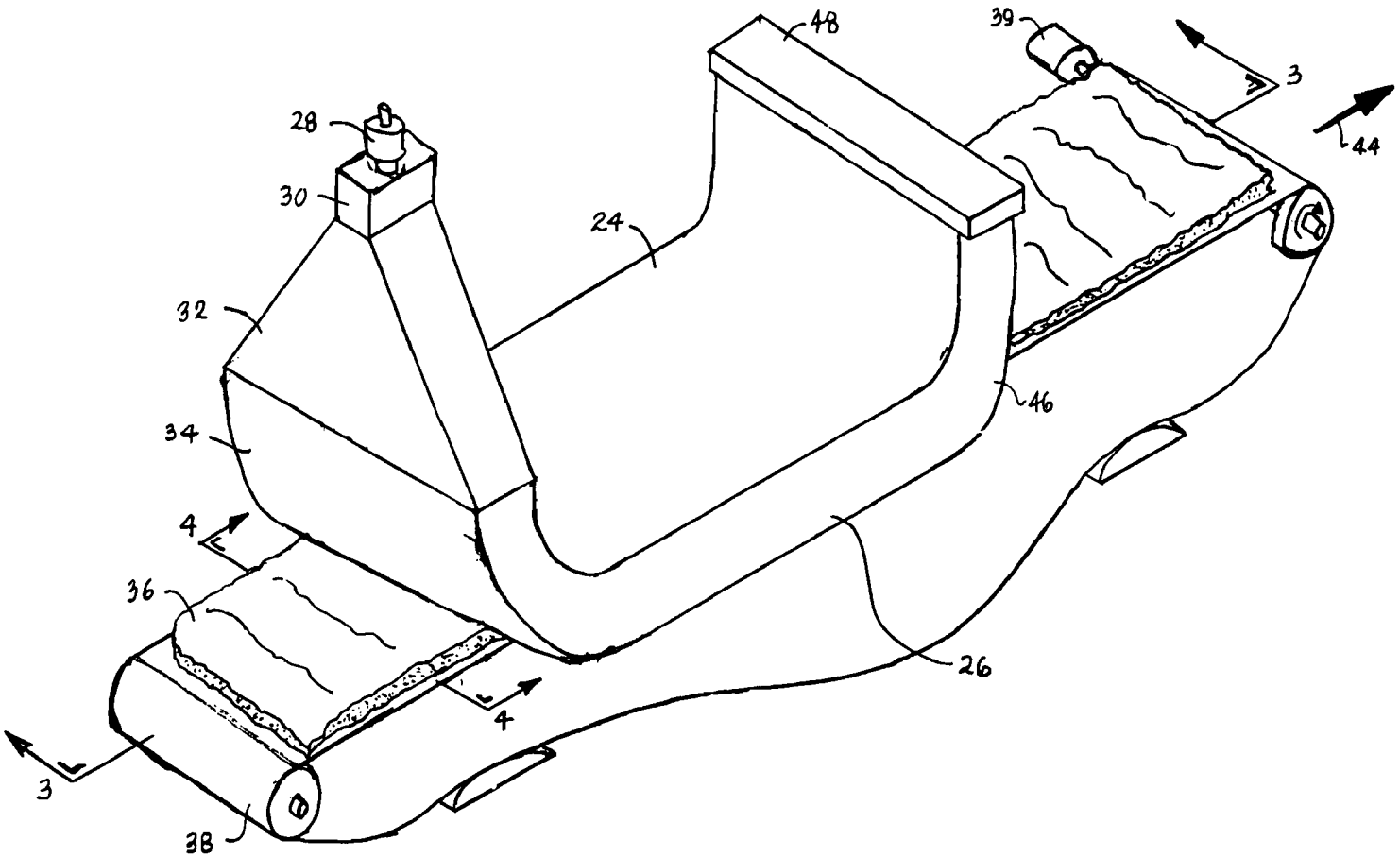
FIG. 2 is an isometric view of a microwave heating chamber as represented in the block diagram of FIG. 1.
Figure 3:
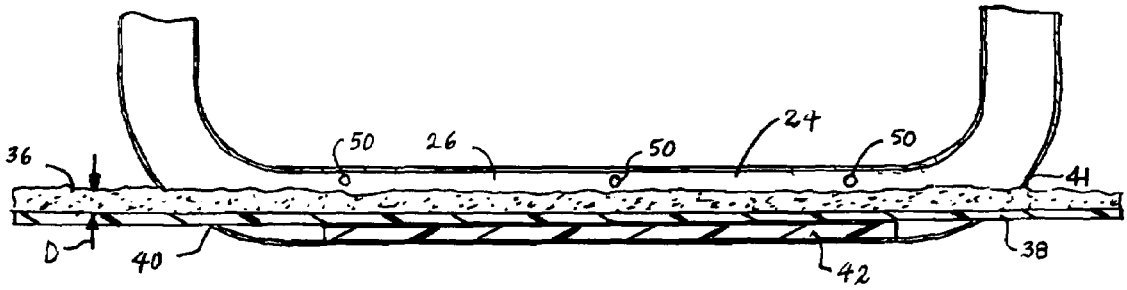
FIG. 3 is a partial side elevation cross section of the heating chamber of FIG. 2 as viewed along lines 3-3.
Figure 4:
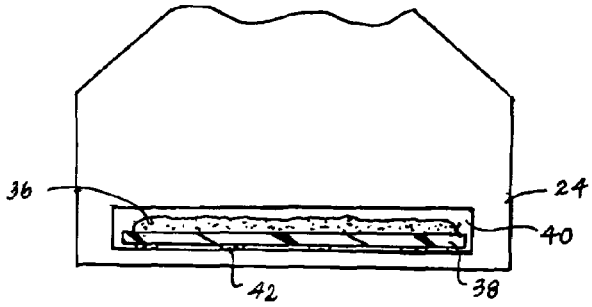
FIG. 4 is a partial front elevation cross section looking toward the heating chamber of FIG. 2 along lines 4-4.

An exemplary microwave heating chamber 24 usable in the plant of FIG. 1 is shown in FIGS. 2-4. The heating chamber shown is a microwave applicator formed by a horizontal section 26 of rectangular waveguide. The chamber is energized by microwave energy generated by a high-power microwave source 28, such as a magnetron. Microwave energy from the source is launched into the chamber by a microwave launcher 30 through a transition waveguide section 32. A bend section 34 in the waveguide allows the microwave source to be positioned out of the way of the coal 36, which is transported through the chamber on a conveyor 38, such as a conveyor belt driven by a motor 39 in a direction of conveyance 44. The conveyor transports coal into the heating chamber for drying through an entrance port 40 and out of the chamber through an exit port 41. The conveyor belt is supported in the chamber on a support 42 attached to the lower wall of the horizontal waveguide.

The electromagnetic energy launched into the heating chamber propagates through the chamber in the direction of conveyance 44. An exit bend 46 in the waveguide preferably terminates in a load 48 to prevent reflections that could form standing waves and hot spots along the length of the heating chamber. A shorter heating chamber terminating in a shorting plate, rather than in a matched-impedance load, could alternatively be used if standing waves are acceptable.

The heating chamber is designed to provide a uniform heat treatment to the coal. Uniform heat treatment means that a given volume of coal is heated substantially the same as any other given volume on average during its dwell time within the drying chamber. The waveguide or microwave source includes provisions for ensuring uniform heating by eliminating hotspots or compensating for them along the length of the chamber through which the coal is transported. Such provisions may include a variable frequency microwave source, positioning conductive or dielectric blocks or fins along the waveguide structure, or mode stirrers, for example. To facilitate uniform heating, the coal is first metered onto the conveyor as a bed of fixed depth D.

Figure 5:
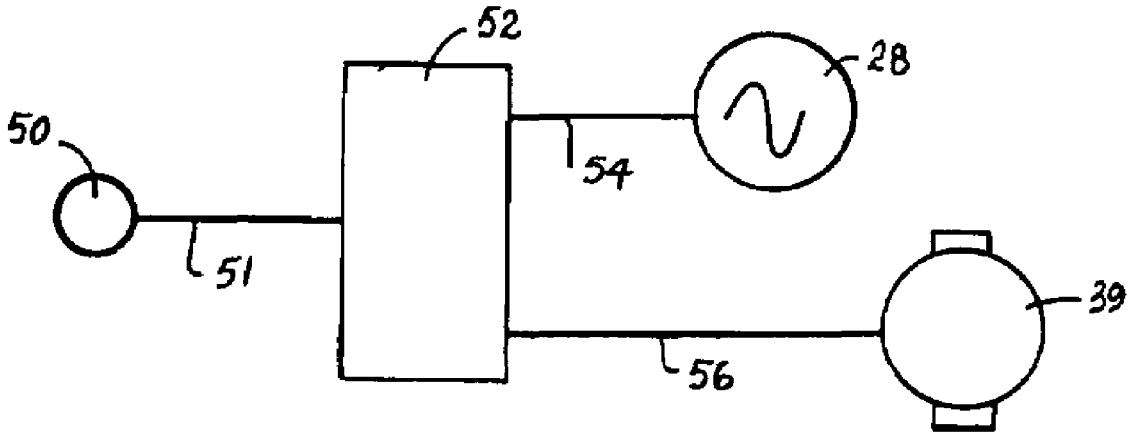
FIG. 5 is an electrical schematic block diagram of a control for the coal preparation plant of FIG. 1.

As the coal is transported through the chamber, its temperature may be monitored by one or more temperature sensors 50. As shown in the electrical block diagram of FIG. 5, the temperature sensors send temperature signals 51 to a controller 52, such as a programmable logic controller or a computer. The controller sends a power-level control signal 54 to the microwave source 28 to lower or raise the microwave power as the temperature increases or decreases from a target value. Alternatively or additionally, the controller could send a speed signal 56 to the conveyor drive (e.g., the motor 39) to speed up or slow down the conveyor.

Because it is important not to start the combustion process or to degrade the coking qualities of the coal by heating the coal to higher temperatures than necessary to evaporate the retained water, the microwave drying chamber has many advantages over other heating systems. By heating volumetrically rather than by conduction, the microwave dryer heats the entire volume of coal uniformly. The outer surfaces of the coal bed do not have to be heated to higher temperatures than the interior. Furthermore, at microwave frequencies, such as 915 MHz or 2450 MHz, energy is preferentially absorbed by the water molecules over the dry coal matter. Consequently, the microwaves evaporate the water without significantly heating the coal. Besides increasing the heating efficiency, the microwave drying keeps the temperature of the coal itself low enough to avoid combustion in thermal coals or oxidation and the concomitant degradation of coking qualities in metallurgical coals. Preferably, the temperature of the coal is maintained below a preferred level of about 90° C. to retain the coking quality of the coal. The temperature sensors are used to maintain the temperature below the preferred level. In this way, one measure of coking quality, CSR (coke strength after reaction with $CO_2$), can be maintained. Furthermore, because certain impurities in the coal, such as sulphur, phosphorous, and other alkalis, heat at different rates than coal, the microwave treatment may serve to reduce them without oxidizing the coal. For example, pyritic sulphur in the coal heats at a faster rate than the carbon constituents and may burn off before the carbon burns or the coking qualities of the coal are affected.

Figure 6A:
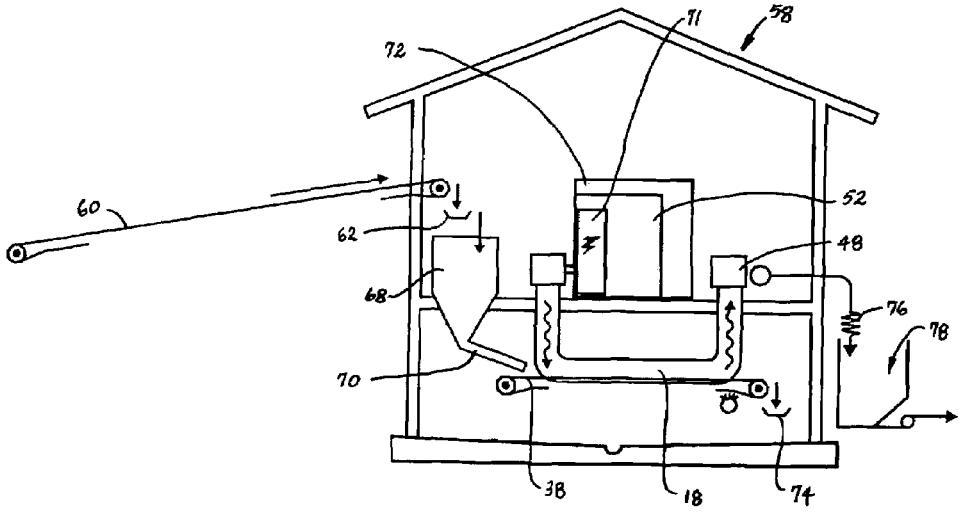
FIGS. 6A and 6B are side elevation and top plan view schematics of a coal dewatering unit in a coal preparation plant using microwave heating chambers as in FIG. 2.
Figure 6B:
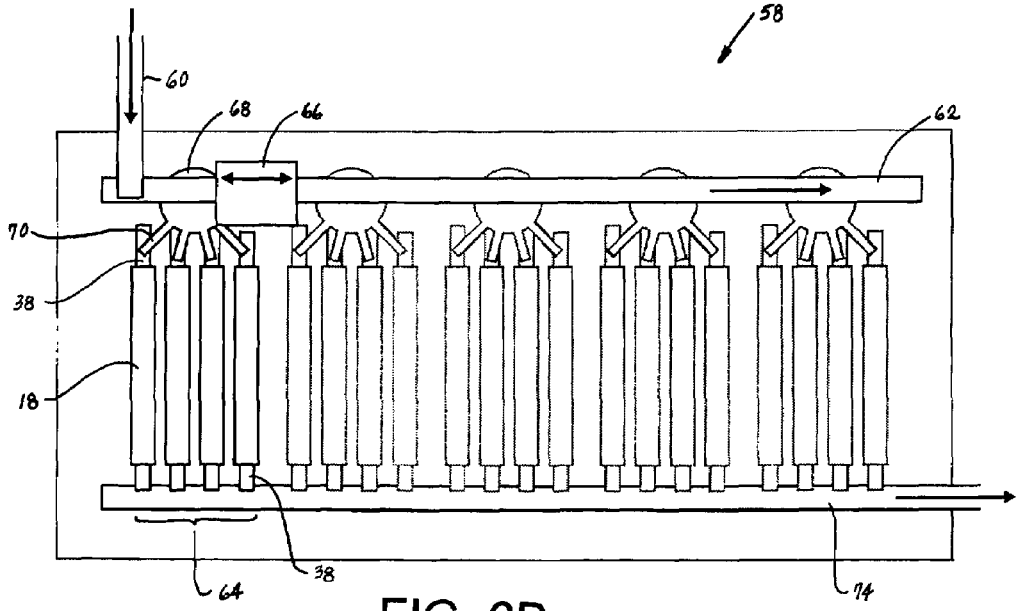

More details about an exemplary microwave dewatering system are shown in FIGS. 6A and 6B. A graded coal fraction is transported into a microwave dewatering unit 58 on a product infeed conveyor 60. The coal drops from the infeed conveyor onto a tripper conveyor belt 62 that runs the length of an array of one or more groups 64 of one or more microwave heating chambers 18. A tripper car 66 riding back and forth along the tripper conveyor receives coal from the tripper conveyor and deposits the coal into screw-fed hoppers 68 with multiple discharge chutes 70. The hoppers distribute the coal evenly to the heating chambers. The coal is loaded through the chutes to form a bed of coal with a generally uniform thickness atop each of the conveyors 38 traveling through the heating chambers. The uniformity of the bed depth is sufficient to achieve an even temperature profile and generally homogeneous heating and dewatering of the coal. Each microwave applicator 18 is energized by a microwave source controlled, along with the conveyors, by a controller 52 and associated electronics and power supplies 71 housed, for example, in an electronics rack or room 72. The heating chamber conveyors 38 feed the dewatered coal onto an outfeed conveyor 74, which transports the dewatered coal out of the dewatering unit for shipment or use. The microwave applicator 18 is shown terminated in a load 48 cooled by a condenser 76 and a sump 78.

Although the invention has been described with reference to a preferred version, other versions are possible. For example, the coal may be transported through the drying chamber opposite to the direction of propagation of the microwave energy. As another example, the closed-loop control may be operated open loop, especially if the characteristics of the coal are known to be within certain ranges for which empirical data on optimal power levels and conveying speeds have been gathered. So, as these few examples suggest, the scope of the invention is not meant to be limited to the exemplary versions described in detail.

What is claimed is:

1. A method for drying coal to achieve a controlled aggregate moisture content target range without starting combustion or degrading the coking qualities of the coal, the method comprising:

separating a feed stock of coal by size into a first grade coal and one or more other grade coals;

loading the first grade coal onto a conveyor to a generally uniform bed depth;

continuously conveying the bed of first grade coal along the conveyor through a waveguide heating chamber in a direction of conveyance for drying;

propagating microwave energy through the waveguide heating chamber along the direction of conveyance to subject the bed of first grade coal to uniform heating in the heating chamber;

combining the first grade coal dried in the heating chamber with the one or more other grade coals to form a dried aggregate having a reduced moisture content;

setting the speed of the conveyor and the microwave power level of the heating chamber to reduce the moisture content of the first grade coal sufficiently so that the reduced moisture content of the dried aggregate is within the aggregate moisture content target range.

2. The method of claim 1 wherein the microwave power level is set to heat the bed of first grade coal conveyed through the heating chamber to a temperature not exceeding about 90° C.

3. The method of claim 1 further comprising conveying the first grade coal dried in the waveguide heating chamber through a second waveguide heating chamber to further dry the first grade coal.

4. The method of claim 1 further comprising loading one of the other grade coals onto a second conveyor to a generally uniform bed depth and continuously conveying the bed of coal along the second conveyor through a second waveguide heating chamber for drying.

5. The method of claim 1 wherein the first grade coal is fine grade coal and the other grade coals are larger grade coals.

6. A method for drying coal comprising:

loading coal onto a conveyor to a generally uniform bed depth;

conveying the bed of coal continuously through a waveguide heating chamber in a direction of conveyance;

subjecting the bed of coal to a uniform heat treatment in the heating chamber by propagating microwave energy through the heating chamber along the direction of conveyance to remove moisture from the coal;

setting the conveyor speed and the microwave power level to maintain the temperature of the coal in the heating chamber below about 90° C.

7. The method of claim 6 further comprising conveying the bed of coal through a second waveguide heating chamber to further reduce the moisture content of the coal.

8. The method of claim 6 wherein the heat treatment in the heating chamber is controlled to maintain the coke strength after reaction to $CO_2$ (CSR) of the coal.

9. A method for processing an aggregate of coal comprising:

separating a feed stock of wet coal by size into a first grade coal and one or more other grade coals;

determining the moisture content of each of the grades of wet coal;

conveying the first grade coal through a waveguide heating chamber in a direction of conveyance;

propagating microwave energy through the waveguide heating chamber along the direction of conveyance to uniformly heat the first grade of coal to produce a dewatered first grade coal having a reduced moisture content;

combining the dewatered first grade coal and the one or more other grade coals to form an aggregate dewatered coal having a reduced aggregate moisture content;

adjusting the heat treatment of the first grade coal in the heating chamber to reduce the moisture content of the first grade coal sufficiently so that the reduced aggregate moisture content meets a specified aggregate moisture content target.

10. The method of claim 9 wherein the heat treatment of the first grade coal in the heating chamber is adjusted to heat the first grade coal to a temperature not exceeding about 90° C.

11. The method of claim 9 wherein the heat treatment in the heating chamber is controlled to maintain the coke strength after reaction to $CO_2$ (CSR) of the first grade coal.

12. The method of claim 9 further comprising conveying the first grade coal dewatered in the waveguide heating chamber through a second waveguide heating chamber to further dewater the first grade coal.

13. The method of claim 9 further comprising loading one of the other grade coals onto a second conveyor to a generally uniform bed depth and continuously conveying the bed of other grade coal along the second conveyor through a second waveguide heating chamber for dewatering.

14. The method of claim 9 wherein the first grade coal is fine grade coal and the other grade coals are larger grade coals.

* * * * *